United States Patent [19]

Kant

[11] 4,415,220

[45] Nov. 15, 1983

[54] COMPLIANT CONTACT PIN

[75] Inventor: Rishi Kant, Budd Lake, N.J.

[73] Assignee: Bell Telephone Laboratories, Incorporated, Murray Hill, N.J.

[21] Appl. No.: 268,384

[22] Filed: May 29, 1981

[51] Int. Cl.[3] ..... H01R 9/16

[52] U.S. Cl. ..... 339/221 R

[58] Field of Search ..... 339/220, 221

[56] References Cited

U.S. PATENT DOCUMENTS

| | | | |
|---|---|---|---|
| 2,685,074 | 7/1954 | Lazzery | 339/221 R |
| 3,223,960 | 12/1965 | Ruehlemann | 339/221 R |
| 3,444,617 | 5/1969 | Stricker et al. | 29/626 |
| 3,539,954 | 11/1970 | Camire | 333/79 |
| 3,566,343 | 2/1971 | Kinkard | 339/221 R |
| 3,602,875 | 8/1971 | Pierini | 339/221 M |
| 3,824,554 | 7/1974 | Shoholm | 339/221 R |
| 3,907,400 | 9/1975 | Dennis | 339/221 R |
| 4,066,326 | 1/1978 | Lovendusky | 339/221 M |
| 4,223,970 | 9/1980 | Walter | 339/220 R |

*Primary Examiner*—Joseph H. McGlynn
*Attorney, Agent, or Firm*—W. H. Kamstra; R. T. Watland

[57] ABSTRACT

An electrical terminal pin (10) adapted for engagement with a plated-through hole in a printed wiring board backplane. The pin includes at least one end (12) for receiving electrically conductive elements and an S-shaped compliant portion (16) adapted and dimensioned to minimize deformation of the plated-through hole. The compliant portion (16) includes a transition section (17) in which the S-shaped cross section evolves from the square cross section of the end (12) of the pin (10). Because of the varying dimensions in the transition section (17), a smaller plated-through hole, which requires more "conditioning" than a larger hole, will be first encountered by a relatively stiffer part of the pin (10). As a result, the tolerance required in the production of plated-through holes may be increased.

7 Claims, 9 Drawing Figures

COMPLIANT CONTACT PIN

TECHNICAL FIELD

This invention relates to terminal pins for electrical interconnection apparatus and particularly to such pins having compliant cross sections.

BACKGROUND OF THE INVENTION

Interference-fit terminal pins are widely used in printed wiring board backplanes to interconnect not only electrical components on either side of the backplane but also to make connections to circuitry carried on the backplane. An interference-fit pin must be designed so that sufficient retention forces are generated when it is inserted into a compatible plated-through hole of the backplane. It is equally important to minimize deformation of the hole plating and surrounding epoxy so that a reliable connection can be achieved if and when a replacement pin must be inserted. Such deformation may occur when pins of uniform cross section are fitted into backplane plated-through holes having varying plating thicknesses due to permissible plating tolerances. These tolerances have been increased, and thereby the plating cost reduced, by employing pins having an insertion portion which complies with varying hole sizes.

One terminal pin having a compliant insertion portion of an S-shaped cross section is disclosed in U.S. Pat. No. 3,444,617 of A. A. Stricker et al. issued May 20, 1969. In this and in other known arrangements, after the pin has been fully inserted in the backplane hole, its insertion portion flexes to adjust to the hole diameter, the spring action of the pin insertion portion maintaining positive electrical contact. However, the high retention force requirement imposes a definite limit on the compliance of the insertion portion. In the past, compliant terminal pins have proved largely satisfactory when the diameter of the plated-through holes has been held within fairly close tolerances. Where attempts are made to further increase the tolerances to achieve an additional reduction in plating costs, existing pins have proved inadequate because the transition section between the pin proper and the flexible compliant portion has either been so rigid that it deforms the plating of an oversized plated-through hole and thereby degrades the electrical connection achieved upon full insertion or so compliant that it does not sufficiently "condition" an undersized plated-through hole to receive the fully developed cross section yet to come. Accordingly, it is an object of the present invention to provide a compliant contact pin wherein the stiffness of the transition section encountered by a backplane plated-through hole varies precisely with the hole diameter.

SUMMARY OF THE INVENTION

The aforementioned objective is advantageously realized in accordance with the principles of the invention in an electrical terminal pin having an end for receiving electrically conductive elements and a compliant portion extending from that end adapted for insertion in, and making electrical contact with a plated-through hole of an electrical component. The compliant portion comprises a pair of oppositely directed C-shaped arms which present a substantially S-shaped cross section. The compliant portion also has a transition section in which the S-shaped cross section evolves from the cross section of the end of the pin where the radii of the C-shaped arms are a minimum to the ultimate cross section of the compliant portion where the radii of the C-shaped arms are a maximum. Because of the increase of the radii from zero to a maximum, the compliance of the transition section increases from a minimum compliance to a maximum compliance. As a result, the normal stress at the plated-through hole and interference-fit pin interface varies inversely with hole diameter at the point of contact. Accordingly, an undersized plated-through hole is properly "conditioned" by pin insertion to receive the fully developed compliant portion but a larger plated-through hole is subjected to relatively less "conditioning". Hole tolerances may thus be significantly increased without adversely affecting the quality of the connection that is ultimately achieved.

BRIEF DESCRIPTION OF THE DRAWING

The features and advantages of a compliant contact pin according to the principles of this invention will be better understood from a consideration of the detailed description of the organization and operation of one illustrative embodiment thereof which follows when taken in conjunction with the accompanying drawing in which.

DETAILED DESCRIPTION

Figure 1:
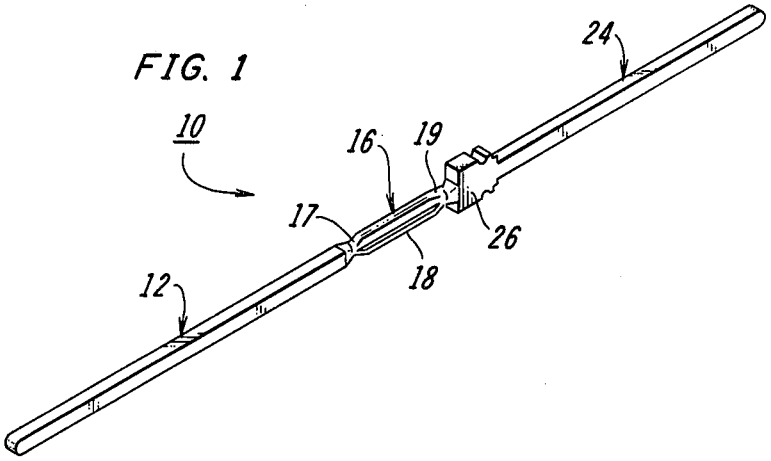
FIG. 1 is an overall perspective view of a terminal pin incorporating a compliant portion according to the invention.

As shown in FIG. 1, contact pin 10 includes two conductive ends 12 and 24 which extend oppositely from a compliant portion 16 adapted for insertion in, and making electrical contact with, a plated-through hole of a typical printed wiring board backplane. End 24 conventionally includes a shoulder 26 which serves to aid the insertion of pin 10 into such a plated-through hole.

Figure 2:
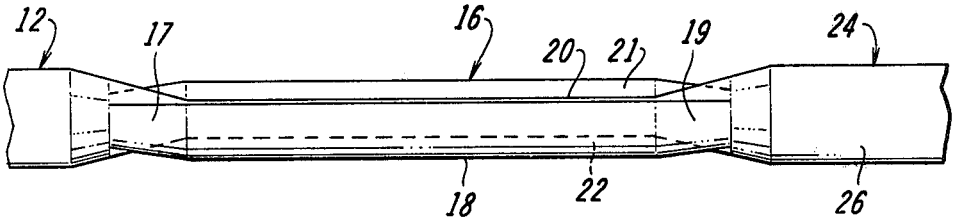
FIGS. 2 and 3 are enlarged top and side views, respectively, of the pin compliant portion of FIG. 1.
Figure 3:
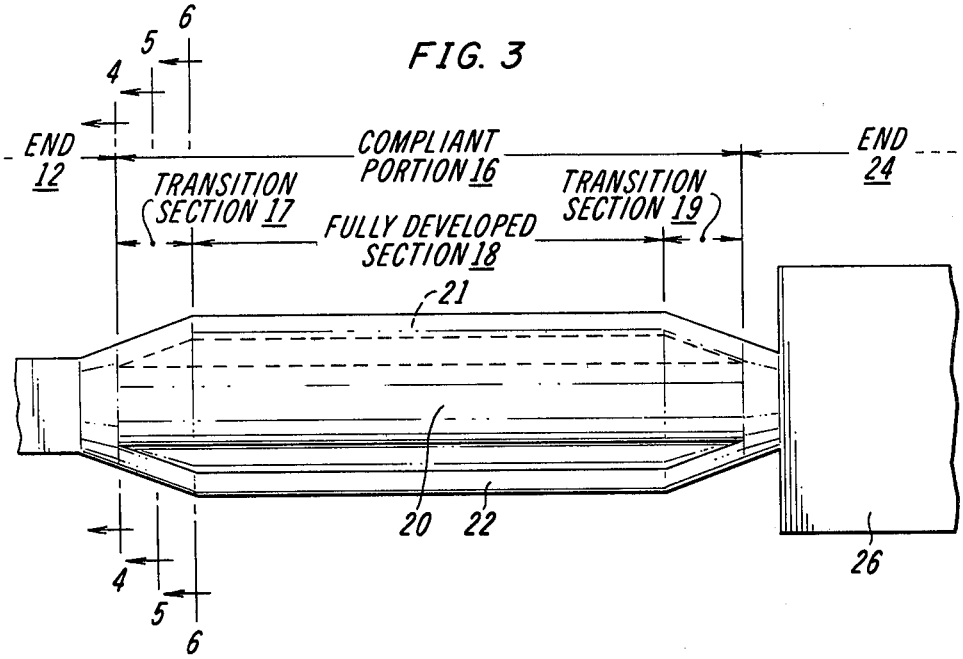
Figure 4:
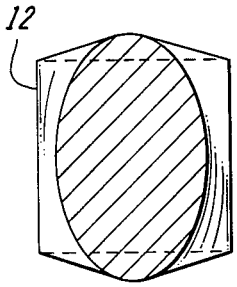
FIGS. 4 through 6 are enlarged cross-sectional views of the pin compliant portion of FIG. 3 as it evolves, the views being taken along line 4—4, midpoint line 5—5, and line 6—6, respectively.
Figure 5:
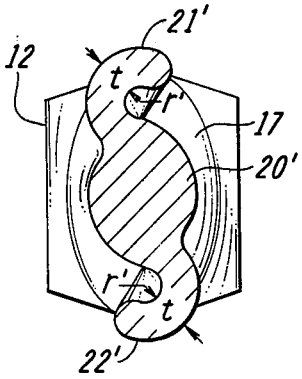
Figure 6:
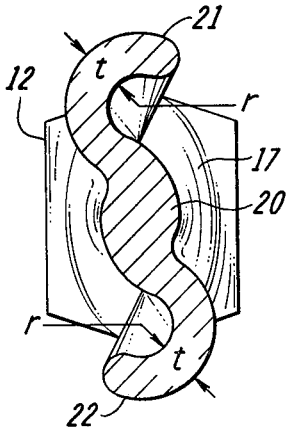

FIGS. 2 and 3 are enlarged top and side views, respectively, of compliant portion 6, which has a central stem 20 and a pair of oppositely directed C-shaped arms 21 and 22 extending outwardly from stem 20 to present a substantially S-shaped cross section (FIG. 6). End 12 evolves from a substantially square cross section to a substantially elliptical cross section (FIG. 4), from which the substantially S-shaped cross section of compliant portion 16 is conveniently developed. Compliant portion 16 includes a fully developed section 18 and two transition sections 17 and 19 which link section 18 with ends 12 and 24, respectively. The shape and dimensions of fully developed section 18 (FIG. 6) are chosen to insure that sufficient retention forces are generated and to minimize the deformation of plated-through holes when contact pin 10 is inserted therein. The symmetry of compliant portion 16 prevents pin 10 from bending upon insertion. The thickness, t, of C-shaped arms 21 and 22 remains constant throughout compliant portion 16; however, their radii increase from a minimum value of zero at the elliptical cross section to a maximum value, r, at fully developed section 18. (FIG. 5 shows an intermediate cross section, having central stem 20' and C-shaped arms 21' and 22' with radii r'.) Because of the varying radii, the stiffness of transition section 17 varies in the axial direction, becoming relatively more compliant as fully developed section 18 is approached. Transition section 19 evolves from end 24 in a similar manner so that deflections in compliant portion 16 are symmetrical when it is inserted into a plated-through hole.

Figure 7:
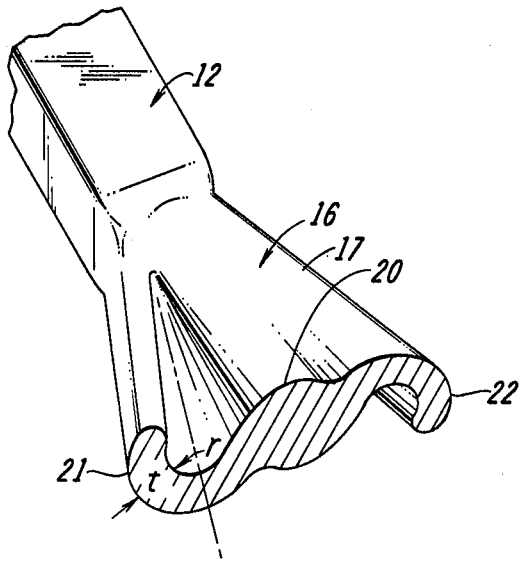
FIG. 7 is a perspective view of a transition section of the pin compliant portion of FIG. 3 terminating at a section of its fully developed end.

FIG. 7 depicts transition section 17 in perspective view. The radial stiffness of section 17 at any given point along the axial direction depends on the shallowness of C-shaped arms 21 and 22, shallowness being defined as the ratio of arm thickness to arm radius. The evolution of the S-shaped cross section is accomplished in transition section 17 along the generatrices of a cone.

Figure 8:
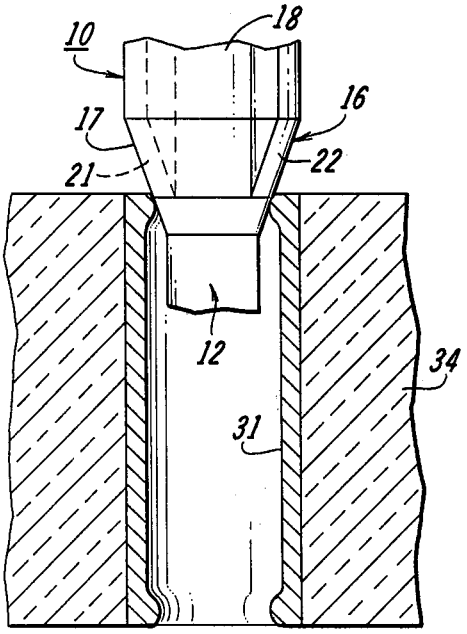
FIGS. 8 and 9 illustrate the insertion of the pin compliant portion into plated-through holes having different diameters.
Figure 9:
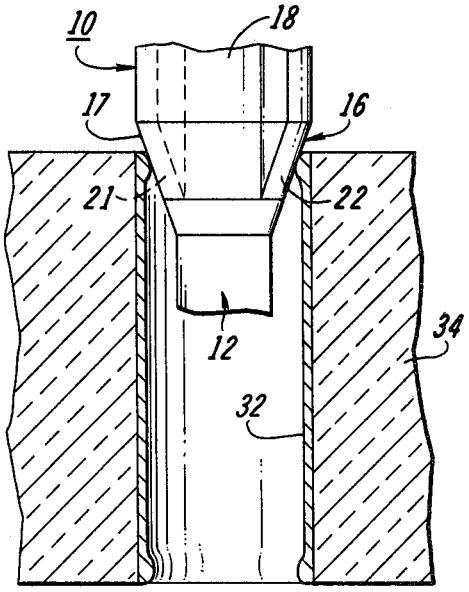

Because of inherent limitations in the production processes involved, the plated-through holes formed in printed wiring board backplanes vary in size. In addition, the diameter varies within each hole because extra material is deposited at its opposite ends. FIGS. 8 and 9 show sectioned portions of a printed wiring board backplane 34 having a smaller plated-through hole 31 and a larger plated-through hole 32, respectively, formed therein. As pin 10 having compliant portion 16 according to the invention is inserted into plated-through hole 31, normal pressure is developed at the interface between transition section 17 and plated-through hole 31 depending on the degree of interference and the stiffness of the pin. As pin 10 moves downward as viewed in the drawing, stress is produced which "conditions" plated-through hole 31 by displacing material to allow fully developed section 18 to enter. However, the magnitude of the interface stress produced during insertion should not be so great as to adversely affect the quality of the electrical connection ultimately achieved. Because of the variable stiffness of transition section 17, plated-through hole 31 will first encounter a relatively stiffer part of pin 10 than would plated-through hole 32. Accordingly, the interface stress produced varies with hole size and a smaller hole is subjected to relatively more "conditioning" than a larger hole. Since the magnitude of interface stress produced conforms to the requirements of plated-through holes of varying sizes, the range of hole sizes that will accommodate the pin and still provide a reliable connection is increased.

What has been described is considered to be only one specific compliant contact pin according to the invention, and it is to be understood that various and numerous other contact pins may be devised by one skilled in the art without departing from the spirit and scope thereof as defined by the accompanying claims.

What is claimed is:

1. An electrical terminal pin having at least one end for receiving electrically conductive elements, and a compliant portion extending from said one end adapted for insertion in, and making electrical contact with a plated-through hole of an electrical component, said compliant portion comprising in the lateral direction a solid cylindrical stem and a pair of oppositely directed, substantially C-shaped arms comprising sectors of cylindrical shells extending from said stem to present a substantially S-shaped cross section, and comprising in the axial direction a fully developed section and a transition section linking said fully developed section with said end evolving from said S-shaped cross section at said fully developed section to a substantially elliptical cross section at said end, wherein the diameter of said solid cylindrical stem is a substantially constant, predetermined diameter throughout said fully developed section but which increases substantially linearly with respect to axial distance from said fully developed section, from said predetermined diameter at said fully developed section to a maximum diameter at said end, wherein the inner radius of each of said sectors is a substantially constant, predetermined radius throughout said fully developed section but which decreases substantially linearly with respect to axial distance from said fully developed section, from said predetermined radius at said fully developed section to a minimum radius of zero at said end, and wherein for any given cross section throughout said fully developed section and said transition section, the thickness of each of said sectors is not greater than the diameter of said solid cylindrical stem, whereby the compliance of said transition section decreases uniformly from a maximum at said fully developed section to a minimum at said end.

2. An electrical terminal pin as claimed in claim 1 wherein the thickness of each of said sectors is substantially constant throughout said fully developed section and said transition section.

3. An electrical terminal pin as claimed in claims 1 or 2 wherein said transition section evolves from said S-shaped cross section at said fully developed section to said elliptical cross section at said end along generatrices of a cone.

4. A compliant portion for an electrical terminal pin adapted for interference fit in a plated-through hole of an electrical component comprising in the lateral direction a solid cylindrical stem, and a pair of substantially C-shaped members comprising sectors of cylindrical shells oppositely extending from said stem to present a substantially S-shaped cross section and comprising in the axial direction a fully developed section and a transition section evolving from said S-shaped cross section to a substantially elliptical cross section, wherein the diameter of said solid cylindrical stem is a substantially constant, predetermined diameter throughout said fully developed section but which increases substantially linearly with respect to axial distance from said fully developed section, from said predetermined diameter to a maximum diameter, wherein the inner radius of each of said sectors is a substantially constant, predetermined radius throughout said fully developed section but which decreases substantially linearly with respect to axial distance from said fully developed section, from said predetermined radius to a minimum radius of zero, and wherein for any given cross section throughout said fully developed section and said transition section, the thickness of each of said sectors is not greater than the diameter of said solid cylindrical stem, whereby the compliance of said transition section decreases uniformly with respect to axial distance from said fully developed section, from a maximum to a minimum.

5. A compliant portion as claimed in claim 4 wherein the thickness of each of said sectors is substantially constant throughout said fully developed section and said transition section.

6. A compliant portion as claimed in claims 4 or 5 wherein said transition section evolves from said S-shaped cross section to said elliptical cross section along generatrices of a cone.

7. An electrical terminal pin (10) having an end (12) for receiving an electrically conductive element and a compliant portion (16) for insertion in a plated-through hole of an electrical component, said compliant portion (16) comprising in the lateral direction a solid cylindrical stem (20) and a pair of oppositely directed, substantially C-shaped arms (21, 22) comprising sectors of cylindrical shells extending from said stem to present a substantially S-shaped cross section and comprising in the axial direction a fully developed section (18) and a transition section (17) linking said fully developed section with said end characterized in that the diameter of said solid cylindrical stem is a substantially constant, predetermined diameter throughout said fully developed section but which increases substantially linearly with respect to axial distance from said fully developed section, from said predetermined diameter at said fully developed section to a maximum diameter at said end, in that the inner radius of each of said sectors is a substantially constant, predetermined radius throughout said fully developed section but which decreases substantially linearly with respect to axial distance from said fully developed section, from said predetermined radius at said fully developed section to a minimum radius of zero at said end, and in that, for any given cross section throughout said fully developed section and said transition section, the thickness of each of said sectors is not greater than the diameter of said solid cylindrical stem.

* * * * *